United States Patent [19]

Itamoto

[11] Patent Number: 4,924,912

[45] Date of Patent: May 15, 1990

[54] ELECTROFLUIDIC PIN TRANSDUCER WITH STABLE NULL SETTING

[75] Inventor: John T. Itamoto, Woodland Hills, Calif.

[73] Assignee: Allied-Signal Inc., Morris Township, Morris County, N.J.

[21] Appl. No.: 447,776

[22] Filed: Dec. 8, 1989

[51] Int. Cl.[5] ..... F15C 4/00

[52] U.S. Cl. ..... 137/831; 137/805; 137/833; 244/3.22

[58] Field of Search ..... 137/804, 805, 806, 829, 137/830, 831, 833; 244/3.22

[56] References Cited

U.S. PATENT DOCUMENTS

| | | | |
|---|---|---|---|
| 3,246,863 | 4/1966 | Posingies | 137/805 |
| 3,610,267 | 10/1971 | Warren | 244/3.22 |
| 3,906,979 | 9/1975 | Chapin | 137/831 |
| 3,934,603 | 1/1976 | Avery | 137/829 |
| 3,965,918 | 6/1976 | Finkbeiner | 137/831 |
| 3,986,856 | 10/1976 | Fournier et al. | 137/805 |
| 4,202,517 | 5/1980 | Young et al. | 244/3.22 |
| 4,747,568 | 5/1988 | Carrigan | 244/3.22 |

*Primary Examiner*—A. Michael Chambers

*Attorney, Agent, or Firm*—Joseph R. Black; James W. McFarland; Robert A. Walsh

[57] ABSTRACT

The invention provides an electrofluidic pin transducer (64) which maintains a stable null setting for a control pin (46). In the control mode of operation, the pin (46) is rotatable in a conventional manner about a first axis which is perpendicular to the longitudinal axis (140) of the pin. In the null setting mode, a cam arrangement (120,122,128) is employed to effect rotational movement of the pin (46) about a second axis (136) which is perpendicular to the first axis and parallel to the longitudinal axis (140) of the pin. This arrangement effectively makes control independent on null setting.

6 Claims, 3 Drawing Sheets

ELECTROFLUIDIC PIN TRANSDUCER WITH STABLE NULL SETTING

TECHNICAL FIELD

The present invention relates generally to fluidic controls and more specifically to eletrofluidic pin transducers. Still more specifically, the invention relates to such transducers that employ a cam arrangement to set the null position of the pin.

BACKGROUND OF THE INVENTION

FIG. 1 schematically illustrates a guided air-to-air missile 10. In operation, a sensing system 12 positioned in the nosecone of the missile 10 continually produces electrical signals that indicate the position of a targeted air vehicle. These signals are communicated along lines 14 to an electronic control system 16 ("ECS"), wherein they are processed to produce electronic control signals 18. The control signals 18 are communicated to coils 20 (FIG. 5) which form the electrical components of a plurality of electrofluidic interfaces 22. The fluidic interfaces 22 govern the flow of nitrogen gas from a pressurized container (not shown) thereof to a plurality of fin actuators 24 in accordance with the magnitudes and polarities of the control signals 18. The fin actuators 24 position four control surfaces (as at 26) to direct the missile 10 to the targeted vehicle.

The fluidic interfaces 22 are typically provided in the form of electrofluidic pin transducers, the fluidic operation of which can be generally understood by reference to FIG. 4. A fluidic circuit element 28 (illustrated by dashed lines) is formed by a laminate subassembly 29, and comprises a supply port 30 and two receiving channels 32, 34. Both receiving channels 32,34 are in fluid communication with a fin actuator 24 (FIG. 1). Fluid is delivered from the pressurized container to the supply port 30. Flow proceeds generally in the direction of a flow path which extends from the center of a nozzle 35 to the center of a flow splitter 36 which is positioned between the receiving channels 32,34. This direction is generally indicated by the x-axis of a directional reference 37 provided in FIG. 4. If either of the receiving channels 32,34 receives more fluid than the other, there is a resulting bias in the fluidic output signals delivered from the receiving channels that can be used by the fin actuator 24 to move the control surface 26.

A boss 38 extending from a flexible beryllium-copper member 40 (FIG. 5A) has two flow windows 42,44 formed therethrough, the windows being separated by a pin 46. The pin 46 is positioned in the flow path just upstream from the flow splitter 36, as indicated by FIG. 3A. By moving the pin 46 in either of the rotational directions indicated in FIG. 3A by the curved arrow 48, fluid flow can be split between the receiving channels 32,34 as necessary to provide the appropriate bias in the forementioned fluidic output signals.

Viewing FIG. 3, movement of the pin 46 is typically accomplished via an electromagnetic subassembly 50 of the pin transducer. The subassembly 50 comprises a magnet 52, a coil 20, first and second pole pieces 54,56, and the forementioned flexible member 40. A control signal 18 (FIG. 1) communicated to the coil 20 produces an electromagnetic field that interacts with the magnetic field continuously produced by the magnet 52. This field interaction causes the coil 20 to rotate to a degree and in a direction dependent upon the magnitude and polarity, respectively, of the control signal 18.

The coil 20 is seated on a flange 58 of the flexible member 40, and the boss 38 is substantially immovable relative to the flange 58. Accordingly, as the coil 20 rotates in either of the directions indicated by the arrow 48, so does the pin 46.

In the manufacture of an electrofluidic pin transducer of the type generally described above, it is important to ensure that the null position of the pin 46 does not drift. The null position is a preset position at which no differential fluidic output is observed for the receiving channels 32,34. The transducer, once assembled, must be subjected to a series of tests to determine whether the null position will hold when the transducer is subjected to various environmental hazards such as vibration and thermal stress.

FIG. 2 schematically illustrates the manner in which adjustment of the null position has been accomplished prior to the present invention. The flexible member 40 in the prior art defines two leaf springs (as at 60) that extend into the fluidic subassembly 29. The leaf springs 60 may be formed, for example, by appropriately cutting and bending portions of the flange 58. Each of these springs 60 rests on the end of a set screw (as at 62) which is disposed in the fluidic subassembly 29. Adjustment of the null position is effected by driving the set screws 62 as needed to position the pin 46 (FIG. 3A). Under that arrangement, movement of the pin 46 for null setting purposes occurs in the same directions 48 (FIG. 3A) as movement for control purposes. Since the null position may be set at various positional combinations of the set screws 62 and thus various tensions of the leaf springs 60, sensitivity to a given magnitude of control signal 18 may vary from interface 22 to interface. Moreover, surface-to-surface contact between the ends of the leaf springs 60 and the ends of the set screws 62 is not a well-defined parameter. If this contact changes due to mechanical shock or thermal stress, for example, the pin 46 may move away from the null position. If such movement happens at any time between shipment of the interface 22 and firing of the missile 10, the accuracy of the missile may be seriously impaired.

An objective of this invention is to provide an electrofluidic pin transducer that consistently maintains a preset null position.

A further objective is to provide such a transducer in which the null position is set by manual rotation of a single adjustment mechanism.

A still further objective is to improve precision and accuracy for guided air-to-air missiles which employ electrofluidic pin transducers as interfaces.

SUMMARY OF THE INVENTION

The invention achieves the above-recited objectives by providing an electrofluidic pin transducer in which rotational movement of the control pin for control purposes is effected about an axis which is substantially perpendicular to the longitudinal axis of the pin, whereas rotational movement of the pin for null setting purposes is effected about a second axis which is substantially parallel to the longitudinal axis of the pin. A cam arrangement is employed to provide the foresaid rotational movement for null setting purposes. Movement for control purposes occurs in the conventional manner, but is uninfluenced by forces which would otherwise result from conventional null setting.

DESCRIPTION OF THE PREFERRED EMBODIMENT

Figure 3A:
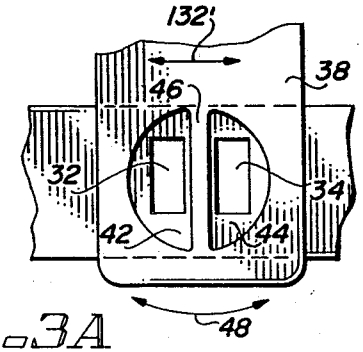
FIG. 3 is a partial cross-sectional and partially schematic view of an electrofluidic pin transducer and illustrates directions of pin movement in both null setting and control modes in accordance with the invention.
Figure 3:
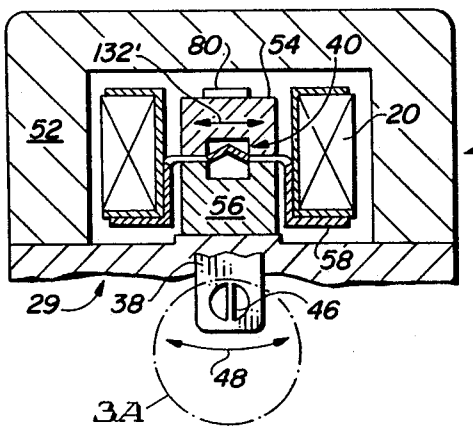
Figure 2:
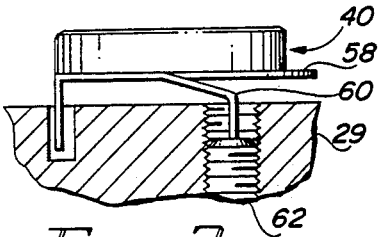
FIG. 2 (PRIOR ART)
FIG. 2 is a partial cross-sectional and partially elevational view that illustrates a known null setting arrangement for electrofluidic pin transducers employed as the interfaces represented in FIG. 1.
Figure 5:
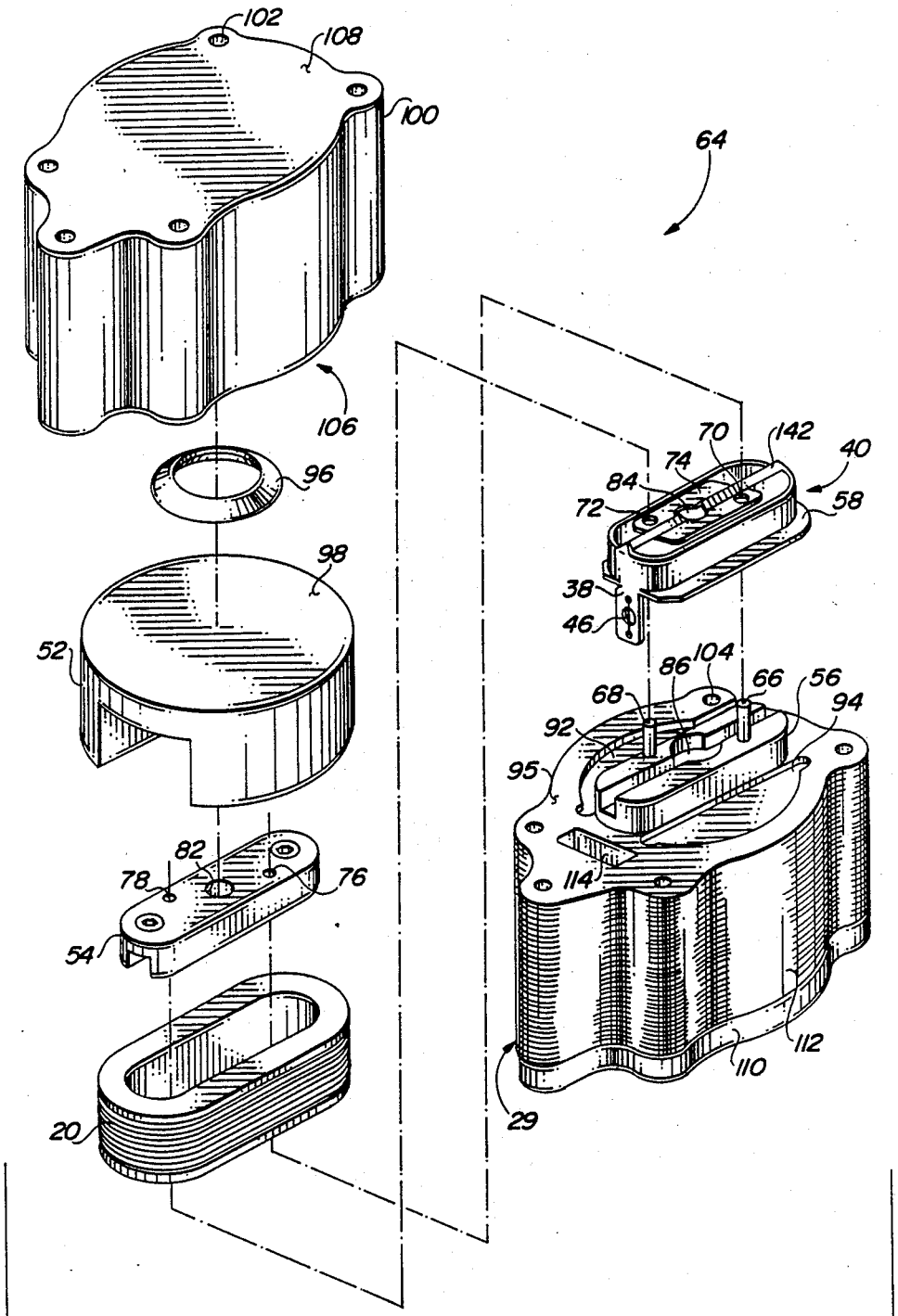
FIG. 5 is a partially-exploded perspective view of the electrofluidic pin transducer.

FIG. 5 illustrates an electrofluidic pin transducer 64 comprising a laminate subassembly 29 which forms a fluidic circuit component of the transducer, and an electromagnetic subassembly 50 (FIG. 3). As stated above, the electromagnetic subassembly 50 comprises the magnet 52, the first pole piece 54, the coil 20, the flexible member 40, and the second pole piece 56, the latter of which is shown seated on the laminate subassembly 29. The pin 46 is provided as a piece of wire which is soldered to the boss 38 of the flexible member 40 and which extends across a hole formed in the boss. The pole pieces 54,56 are composed of a soft iron. Two mounting rods 66,68 are tightly fitted in holes 67,69, respectively, (FIG. 6) formed in the second pole piece 56 and protrude upwardly from the latter. The flexible member 40 and the first pole piece 54 are successively placed so that the rods 66,68 extend through holes 70,72 formed through a centerplate 74 of the flexible member, and into holes 76,78 formed through the first pole piece. Thus, the first pole piece 54 is positioned atop the laminate subassembly 29, the centerplate 74 is positioned atop the first pole piece, and the second pole piece 56 is positioned atop the centerplate 74. The coil 20 is seated on the flange 58, which laterally circumscribes the first pole piece 54 except over a range defined by the boss 38. A threaded bolt 80 (FIGS. 3 and 7) extends through holes 82,84,86 in the first pole piece 54, the centerplate 74, and the second pole piece 56, and into a stepped bore 88 (FIG. 7) formed through the laminate subassembly 29. The bolt 80 is threadedly engaged with a recessed nut 90, (FIG. 7) thus securing the pole pieces 54,56, and flexible member 40 to the laminate subassembly 29. The magnet 52 is seated in recesses 92,94 formed in the top surface 95 of the laminate subassembly 29. A spring washer 96 is centrally placed on the top surface 98 of the magnet 52. An aluminum-alloy housing member 100 is laterally shaped to match the lateral shape of the laminate subassembly 29, and has five bores (as at 102) formed therethrough. These bores 102 are coaxial with bores (as at 104) formed through the laminate subassembly 29. The housing member 100 has a cavity (not shown) extending inwardly from its bottom surface (indicated at 106) to an inner surface (not shown) which is parallel to the top surface 108. The inner surface abuts the spring washer 96 when the housing member 100 is placed atop the laminate subassembly 29. Bolts (not shown) are extended into the coaxial holes (as at 102,104) and threadedly engaged with recessed nuts. As the bolts are tightened, the inner surface of the housing member 100, acting through the spring washer 96, presses the magnet 52 against the laminate subassembly 29 so that when the entire transducer 64 is assembled, the magnet is held in place.

Except as stated hereinafter for purposes of completing the description of the preferred embodiment, the laminate subassembly 29 is manufactured and assembled by conventional means well-known to those skilled in the art. The subassembly 29 has a baseplate 110 atop which a plurality of laminates 112 are stacked. The laminates 112 are designed so that when stacked in proper sequence, they internally form the fluidic circuit element 28 and the required supply and vent channels (not shown). An uppermost plurality of laminates forms a cavity 114 into which the boss 38 extends.

Figure 6:
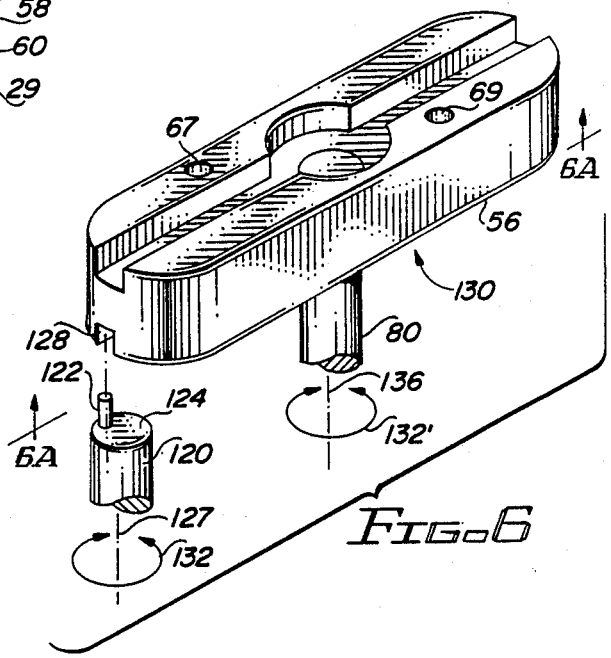
FIG. 6 is a perspective view illustrating a cam arrangement by which null setting is achieved in accordance with the preferred embodiment of the invention.
Figure 7:
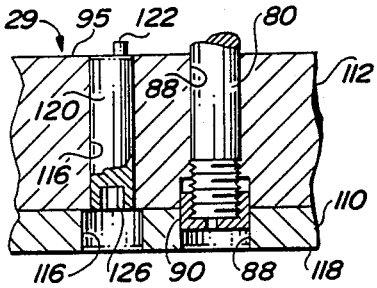
FIG. 7 is a partial cross-sectional view of a laminate subassembly portion of the electrofluidic pin transducer illustrated in FIG. 5, and is included to illustrate installation and use of the cam arrangement illustrated in FIG. 6.

Referring now to FIG. 7, a stepped bore 116 is formed through the laminate subassembly 29 from the top surface 95 to the bottom surface 118 thereof. A shaft 120 having a cylindrical boss 122 protruding from its upper end 124 (FIG. 6) extends into the bore 116 so that the boss 122 protrudes above the top surface 95. The lower end 126 of the shaft 120 is adapted by any suitable means for engagement with a torquing tool which can be used to rotate the shaft about its axis 127 (FIG. 6). As indicated, the boss 122 is displaced from the axis 127.

Referring now to FIG. 6, the second pole piece 56 has a slot 128 formed therein, the slot being located preferably near the rear end of the pole piece (i.e. the end that is not visible in FIG. 5) and extending inwardly from the bottom surface (indicated at 130) of the latter. The cylindrical boss 122 extends into the slot 128, thus engaging the electromagnetic subassembly 50 (FIG. 3).

Figure 6A:
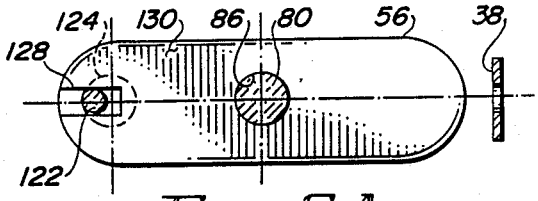
FIGS. 6A–6C are partially cross-sectional and partially elevational views illustrating movement of the pin via the cam arrangement illustrated in FIG. 6. Although these views can be considered as taken along line 6A—6A of FIG. 6, certain features are added to facilitate description.
Figure 6B:
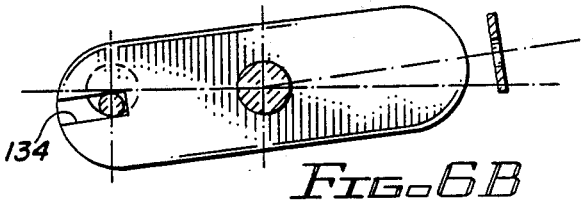
Figure 6C:
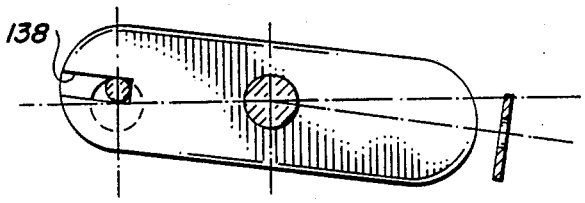

Use of the preferred embodiment will now be described with reference to FIGS. 6, 6A–6C and 7. Note that in FIGS. 6A–6C, the dashed-line circle 124 represents the end 124 of the shaft 120 and is added to aid understanding. Therefore, the circle 124 should not be interpreted as a phantom view of the end 124, since the shaft 120 extends from the boss 122 in a direction toward the viewer of FIGS. 6A–6C. The slot 128 and the cylindrical boss 122 function as a cam and cam follower, respectively. The null position of the pin 46 (FIG. 3A) is set with the nut 90 loosened from the bolt 80. To set the null position, the shaft 120 is rotated as needed in directions indicated by the arcuate arrow 132. If the shaft is rotated in one of the directions 132, the cylindrical boss 122 exerts force on one of the sidewalls 134 defined by the slot 128, and causes the pole pieces 54,56 and flexible member 40 to rotate in one of the directions 132' about the axis 136 of the bolt 80. Accordingly, the boss 38 (FIG. 3A) extending from the flexible member 40 is also caused to rotate in that direction, as indicated in FIG. 6B. Conversely, if the shaft 120 is rotated in the opposite one of the directions 132, the cylindrical boss 122 exerts force on the opposite sidewall 138 defined by the slot 128, and the boss 38 rotates about the axis 136 in the opposite of the directions 132', as indicated by FIG. 6C.

Once set, the null position of the pin 46 is locked-in by tightening the nut 90 onto the bolt 80.

Figure 1:
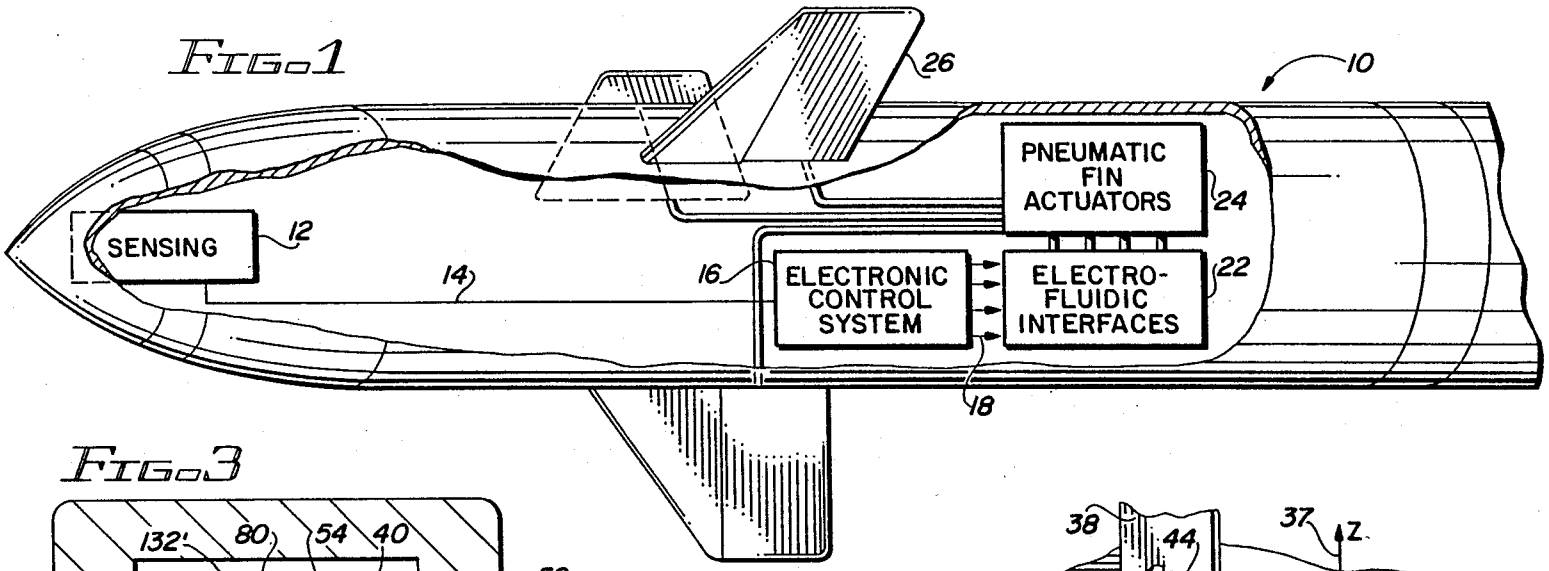
FIG. 1 is a schematic illustration of an air-to-air missile and its associated guidance system.
Figure 4:
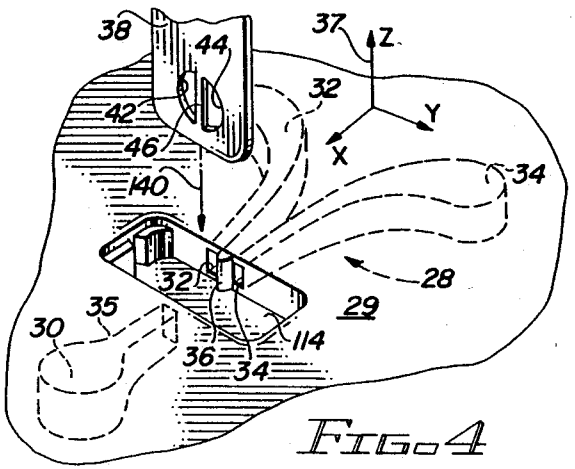
FIG. 4 is a partial perspective view that includes a directional reference and a phantom illustration of a conventional fluidic circuit element, and is included to aid description.

From the above, it should be clear that the axis 136 of the bolt 80 is substantially parallel to the longitudinal axis 140 (FIG. 4) of the pin 40. These axes extend in a direction generally indicated by the z-axis in the reference 37 of FIG. 4, which is perpendicular to the direction of the forementioned flow path.

Movement of the pin 46 for control purposes occurs in the conventional manner, and is substantially rotational about an axis (not shown) which is substantially parallel to the x-axis and substantially perpendicular to the z-axis of the reference 37. This unillustrated axis can be considered as nominally located along the centerplate 74 (FIG. 5) of the flexible member 40, and extending in the longitudinal direction of a gabled cross-member 142 of the latter.

The reader should understand that the foregoing portion of the specification and the accompanying drawings are not intended to restrict the scope of the invention to the preferred embodiment thereof, or to specific details which are ancillary to the teaching contained herein. Accordingly, the invention should be construed as broadly as is consistent with the following claims and their equivalents.

What is claimed is:

1. An electrofluidic pin transducer, comprising:

a laminate subassembly which forms a fluidic circuit component of said transducer, said component having a supply port from which, in operation, fluid is directed along a flow path toward a flow splitter which is positioned between two receiving channels, said subassembly being adapted to receive a pin just upstream from said flow splitter and to permit movement of said pin relative to said splitter:

an electromagnetic subassembly including said pin, said pin having a longitudinal axis, said electromagnetic subassembly being secured to said laminate subassembly such that said pin is received in said laminate subassembly and positioned just upstream from said flow splitter: said electromagnetic subassembly being operable in response to externally-supplied electrical signals to effect limited, bi-directional movement of said pin relative to said flow splitter, said movement being substantially rotational about a first axis which is substantially perpendicular to said longitudinal axis and substantially parallel to said flow path, at least a portion of said electromagnetic subassembly including said pin being bi-directionally and rotationally movable about a second axis which is substantially parallel to said longitudinal axis and substantially perpendicular to said flow path: and manually operable cam means engaging said electromagnetic subassembly for moving said pin about said second axis to position said pin relative to said flow splitter.

2. The invention of claim 1 wherein said cam means comprises a rotatable shaft having a cam follower rigidly secured thereto or integral therewith, said cam follower engaging a cam formed in said electromagnetic subassembly.

3. The invention of claim 2 wherein said cam follower is operable in response to manual, bi-directional rotation of said shaft to effect limited, bi-directional, rotational movement of said pin.

4. The invention of claim 3 wherein said electromagnetic subassembly comprises:

a first pole piece positioned atop said laminate subassembly:

a flexible member having a centerplate positioned atop said first pole piece, said member having a seating flange that substantially laterally circumscribes said first pole piece, said member having a boss including said pin, said boss extending into said laminate subassembly;

a coil positioned atop said flange; and a second pole piece positioned atop said center-plate of said flexible member.

5. The invention of claim 4 further comprising means for maintaining said pole pieces and said member in substantially fixed interrelationship whereby said pole pieces and flexible member can be moved together, but not independently, about said second axis.

6. The invention of claim 5 further comprising means for securing said pole pieces and flexible member to said laminate subassembly, said securing means defining said second axis.

* * * * *